United States Patent [19]

Ishinaga

[11] Patent Number: 4,918,967

[45] Date of Patent: Apr. 24, 1990

[54] FULLY ENCLOSED DIE FORGING APPARATUS

[75] Inventor: Nobuyuki Ishinaga, Sagamihara, Japan

[73] Assignee: Aida Engineering, Ltd., Kanagawa, Japan

[21] Appl. No.: 214,334

[22] Filed: Jul. 1, 1988

[30] Foreign Application Priority Data

Jul. 6, 1987 [JP] Japan ..... 62-168318
Apr. 28, 1988 [JP] Japan ..... 63-105812

[51] Int. Cl.[5] ..... B21J 13/02
[52] U.S. Cl. ..... 72/354; 72/452
[58] Field of Search ..... 72/354, 407, 432, 452

[56] References Cited

U.S. PATENT DOCUMENTS 4,274,276 6/1981 Mettler ..... 72/354
4,653,310 3/1987 Urata et al. ..... 72/354

*Primary Examiner*—Lowell A. Larson
*Attorney, Agent, or Firm*—Kalish & Gilster

[57] ABSTRACT

According to the present invention, there is provided a full enclosed die forging apparatus having an upside die and an underside die disposed opposedly in a vertical direction between a slide and a bolster. There is an upside cylinder mechanism contained in the slide which urges the upside die downward. There is an underside cylinder mechanism contained in the bolster which urges the underside die upward. An upside punch is inserted in the upside die and moves synchronously with the movement of the slide. An underside punch is inserted into the underside die and is supported by the bolster. There is a cam mechanism that causes both punches to rush into the dies, respectively, by moving the upside die and underside die toward the underside punch at a speed slower than the moving speed of the slide.

8 Claims, 9 Drawing Sheets

FULLY ENCLOSED DIE FORGING APPARATUS

BACKGROUND OF THE INVENTION:

1. Field of the Invention

The present invention relates, in general, to die forging apparatus and more particularly relates to a full enclosed die forging apparatus provided with a die moving mechanism which has both punches operate to rush into dies, respectively, by moving a die maintained with contact following the movement of a slide toward a punch on a fixed side at a speed slower than the moving speed of the slide.

2. Description of the Prior Art:

Full enclosed die forging in which raw material is forged in a cavity obtained by having a pair of dies in contact with each other is being widely used for forging various products because yield of the raw material is high, and moreover, products having complex shapes may be manufactured with high accuracy.

Conventionally, full enclosed die forging of molded or forged articles 11 represented by a spider of a triport type, equal velocity joint for automobiles and so forth having shapes as shown in FIG. 9 and FIG. 10 is performed in such a manner than a cylindrical slug 13 as shown in FIG. 11 is inserted in cavities 19 and 21 formed with an upper die 15 and a lower die 17 as shown in left part of FIG. 12, and upper and lower punches 23 and 25 are made close to each other as shown in the right part of FIG. 12.

Thereupon, when the shape of a forged article 11 is of face symmetric with reference to a cross-section 27 having the maximum area as the forged article 11 described above, it is required to operate upper and lower punches 23 and 25 keeping face symmetry with reference to a cross-section 31 of the maximum area of a cavity 29 while maintaining such a state that abovementioned upper die 14 and lower die 17 are made to contact with each other and enclosing force is applied.

Because of such reason, a full enclosed die forging apparatus as shown in FIG. 13 has been used conventionally.

For such a full enclosed die forging apparatus, a hydraulic or mechanical double action press is illustrated, and the left half of the drawing shows the state before forging and the right half of the drawing shows the state after forging, respectively.

In the drawing, reference numeral 11 denotes a forged article, 13 denotes a slug, 15 denotes an upper die, 17 denotes a lower die, 23 denotes an upper punch, 25 denotes a lower punch, 33 denotes a slide of a press, 34 denotes a bolster, 35 denotes a bed, 36 denotes an upper pressure pin and 37 denotes a lower pressure pin.

In this full enclosed die forging apparatus, first, slug 13 is charged by hand or by a feeding device into a cavity 38 of the lower die 17. Next, when the slide 33 of the press descends, the upper and lower dies 15 and 17 come in contact with each other. In a hydraulic press, the slide 33 is urged downward by means of a hydraulic device, and in a mechanical press, the slide 33 stops at the bottom dead center, thereby to apply enclosing force to the upper and lower dies 15 and 17.

In succession, in a hydraulic press, a hydraulic unit which is of a different system from the unit for driving the slide 33 is installed on the side of the slide 33 and is operated on the side of the bed 35. In a mechanical press, a driving unit installed separately from the unit for driving the slide 33 is operated in the same manner as in the case of the hydraulic press. With this, the upper and lower pressure pins 36 and 37 are operated, the upper and lower punches 23 and 25 are moved toward abovementioned cross-section 31, and the slug 13 is pushed out for working toward the cavity 29 formed by the upper and lower dies 15 and 17.

Then, after forging, the slide 33 is ascended and the upper and lower dies 15 and 17 are separated. During ascending or at the upper limit thereof, the upper and lower punches 23 and 25 are operated by the hydraulic unit, and the forged article 11 is discharged out of the die.

However, it is required to employ a double action press in order to apply such a full enclosed die forging apparatus to a hydraulic press. Accordingly, a special purpose machine is required for the formed article 11, which spoils universality. Also, in case of temperature change of pressure oil for operating the upper and lower punches 23 and 25, mixing of bubbles into the pressure oil and so forth are generated, the speed of the upper and lower punches 23 and 25 is changed, which makes it possible to secure the product accuracy of the forged article 11. In order to avoid this, it has been required to add a correction mechanism which properly performs flow control.

Besides, in case of application to a mechanical press, a special purpose machine in which a drive unit for driving the upper punch 35 is provided on the side of the slide 33 and also requires a pressure drive unit on the side of the bed 35. Moreover, the upper and lower dies 15 and 17 being fitted together at the bottom dead point, causes the enclosing force to become unstable. Therefore, more enforcing force than required is applied to the press and the upper and lower dies 15 and 17, which reduces the life of the metal mold.

The subject applicant has previously applied for patent on a full enclosed die forging apparatus which is laid open under Provisional Publication No. 133927/84 as a full enclosed die forging apparatus which is capable of solving such problems.

FIG. 14 shows a full enclosed die forging apparatus disclosed in said Publication. The left half of the Figure shows a state when full enclosing is commenced, and the right half thereof shows the state when forging is completed at the bottom dead point.

In this Figure, an upside die set plate 61 is fixed to a slide 60 of the press, and an insert plate 62 is inserted into plate 61 with positioning by a knock pin 63.

In said slide 60, a cushion pin 65 is urged downward by installing a cushion rod 64 which is also urged downward by pressure liquid so as to ascend and descend freely. Similarly, a knockout rod 66 is provided in the slide 60 so as to ascend and descend freely.

An upside die holder 67 is fixed to the upside die set plate 61, a cam holder 68 is fixed to this die holder 67, and furthermore, a first cam 69 is fixed to the cam holder 68. Besides, this first cam 69 drives the lower die through second, third and fourth cams which will be described later.

An upper die 70 is fitted to the inside of the upside die holder 67 so as to ascend and descend freely. A punch block 71 and an upper punch 72 are fitted to the inside of this upper die 70 so as to ascend and descend freely.

On the other hand, an underside die set plate 74 is fixed to a bolster 73, and an insert plate 75 is inserted into this die set plate 74.

Further, in the bolster 73, a knockout rod 76 is provided so as to push up a knockout pin 77 at a constant timing by receiving a pushing-up force by liquid pressure or a mechanical device. In a similar manner, in the bolster 73, a cushion rod 78 is provided so as to urge a cushion pin 79 in the insert plate 75 upward.

To the underside die set plate 74, an underside die hole 80 is positioned and fixed with a knockout pin 81, and a plate 83 is positioned and inserted into this die holder 80 through a knockout pin 82.

Further, in the underside die holder 80, pads 84 and 85 are built in, and a spring 86 is installed under compressed condition between these pads 84 and 85. Spring 86 urges a lower die which is described later upward through a pressure pin 87 penetrating the plate 83 and said pad 84.

Inside spring 86, is disposed a cushion ring 88 so as to ascend and descend freely, and the urging force of the cushion pin 79 is arranged so as to be conveyed to a lower die 90 from a pressure pin 89 through this cushion ring 88.

It is also arranged that, at the center of the upper surface of insert plate 75, a die anvil 92 is provided that penetrates a punch block 91 so as to ascend and descend freely, and a lower punch 93 is pushed up with a predetermined timing receiving pushing-up action of a knockout pin 77 by attaching a lower punch 93 on the upper part of the punch block 93.

On the other hand, a guide 95 for guiding a second cam 94, etc. is fixed to said underside die holder 80. This second cam 94 is held by fitting slidably at a bore portion of the guide 95 having a circular form, and the bore portion of this cam 94 is fitted to the lower die 90. A step portion **94*a* of the cam 94 is engaged with the step portion of the lower die 90, and then cam 94 is held by fitting slidably in a vertical direction only in a guide groove 96 along the center of the die 90**.

Further, third and fourth cams 97 and 98 which are held slidably in a circumferential direction only by the lower die 90 and the guide 95 are provided between first cam 69 and second cam 94. Thus, when first cam 69 descends, second cam 94 moves downward through third and fourth cams 97 and 98.

FIG. 15 through FIG. 17 are drawings showing the locations and operating condition of these cams. As seen from these drawings, two pieces of the first cams 69 are provided at diagonal locations of the cam holder 68 and formed in a cleat shape contracting downward, and the inclined faces of these first cams 69 are made to face between end inclined faces of adjacent third and fourth cams 97 and 98 from the upper part.

Also, second cam 94 is provided at a location the phase of which is shifted from first cam 69 by 90° and formed in a cleat shape expanding downward, and by having the inclined surface face between point inclined faces of the third and the fourth cams 97 and 98 from the lower part, the third and the fourth cams 97 and 98 are moved in a circumferential direction thereby to push the second cam downward when the first cam 69 descends. Besides, the base ends of the third and the fourth cams 97 and 98 are formed into inclined faces going upward and the point ends are formed into inclined faces going downward. In a full enclosed die forging apparatus thus constructed, the slug inserted into the cavity of the lower die 90 is formed under a condition that upper and lower dies 70 and 90 are fully enclosed, and is taken out by the operation of the knockout pin 77, etc.

Thereupon, in this full enclosed die forging apparatus, at the same time as upper and lower dies come in contact with each other, third and fourth cams 97 and 98 and first cam 69 contact with each other as shown in FIG. 16. Therefore, when the slide 60 descends and first cam 69 also descends, adjacent third cam 97 and fourth cam 98 are moved in a horizontal direction, and second cam 94 which is put between both cams 97 and 98 is pushed downward. As the result, die 90 which is engaged with second cam 94 descends.

The descending speed of this die 90 is made slower than the descending speed of the punch 72 by setting the angle of each cam face at a predetermined angle, and upper and lower punches 72 and move relatively to upper and lower dies 70 and 90.

In short, despite that upper and lower dies 70 and 90 descend at a lower speed than the descending speed of the upper punch 72, the lower punch 93 does not move. Accordingly, when the slide 60 is made to descend, upper and lower punches 72 and 93 rush into upper and lower dies 70 and 90, respectively, and move closely, thereby to perform expected molding.

In such a conventional full enclosed die forging apparatus, however, the first cam 69 is attached to the mold forming member of the upper mold and ascends and descends together with the slide, a cam mechanism is disposed on the outer circumference of the lower die 90, and the spring 86, etc. is disposed in the die holder 80. Accordingly, handling of the apparatus is troublesome, a big clearance is required between the slide 60 and the bolster 73 because the apparatus rises high, and it takes time for replacement of the mold unit.

SUMMARY OF THE INVENTION

Therefore, it is an object of the present invention to provide a full enclosed die forging apparatus which is capable of simplifying the construction of a die set and a metal most and reducing the clearance between a slide and a bolster.

It is a further object of the present invention to provide a full enclosed die forging apparatus for producing forged articles of high accuracy.

It is a still further object of the present invention to provide a full enclosed die forging apparatus wherein the clearance between the slide and the bolster may be reduced by a large margin as compared with the prior art.

It is another object of the present invention to provide a full enclosed die forging apparatus that has a reduced number of parts as compared to the prior art.

It is a still further object of the present invention to provide a means for fine adjustment of positions of the lower positions of pistons which produces greater dimensional adjustment of forged articles than the prior art.

It is another object of the present invention to provide a full enclosed die forging apparatus wherein stabilized forged articles of high accuracy are obtainable by adopting an auxiliary cylinder.

DESCRIPTION OF THE PREFERRED EMBODIMENT OF THE INVENTION:

According to the present invention, there is provided a full enclosed die forging apparatus provided with an upside die and an underside die disposed opposedly in a vertical direction between a slide and a bolster, an upside cylinder mechanism which urges said upside die downward, an underside cylinder mechanism which urges said underside die upward, an upside punch which is inserted in said upside die and moves synchronously with the movement of said slide, an underside punch which is inserted into said underside die and supported by said bolster, and a cam mechanism having both punches operated to rush i.e., accelerate, into dies, respectively, by moving said upside die and underside die toward the underside punch at a speed slower than the moving speed of said slide, wherein: said upside cylinder mechanism is contained in said slide, and said underside cylinder mechanism is contained in said bolster.

In the full enclosed die forging apparatus according to the present invention, opposing upside die and underside die are urged and maintained with contact during forging, respectively, by means of the upside cylinder mechanism and the underside cylinder mechanism contained in the slide and the bolster, respectively. Then, the upside punch inserted through the upside die is slidably moved toward the underside punch. At this time, the upside die and the underside die which are maintained with contact are moved toward the underside punch at a speed lower than the moving speed of the slide, and the upside punch and the underside punch are operated to rush into the upside die and the underside die, respectively.

The details of the present invention will be described hereinafter by referring to embodiments shown in the accompanying drawings.

Figure 1:
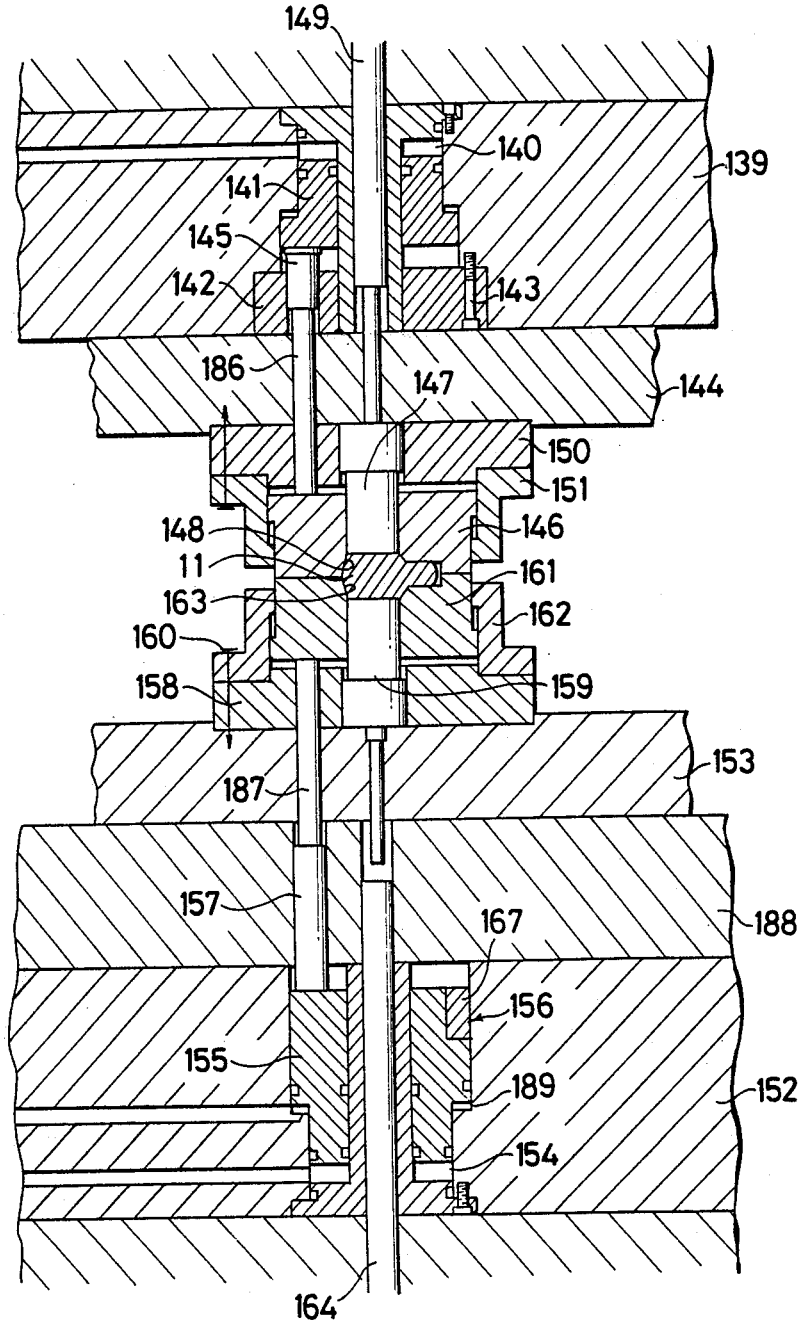
FIG. 1 is a longitudinal cross-sectional view showing an embodiment of a full enclosed die forging apparatus according to the present invention.

FIG. 1 shows an embodiment of a full enclosed die forging apparatus according to the present invention. In this full enclosed die forging apparatus, an upside cylinder 140 is formed in a slide 139, and an upside piston 141 is inserted into this upside cylinder 140.

An upside insert plate 142 is fixed with a bolt 143 to the slide 139, and an upside die set plate 144 is fixed to the lower face of the slide 139.

An upside actuating pin 145 is disposed on the lower face of the upside piston 141, and the lower end of this upside actuating pin 145 abuts against the upper face of an upside die 146 through a pin 186 that slidably penetrates the upside die plate 144.

An upside punch 147 is inserted at the central portion of the upside die 146, and a cavity 148 corresponding to the shape of an article 1 to be forged is formed at the lower part of this upside die 146.

Penetrating through central portions of the upside die set plate 144 and the upside insert plate 142, is disposed a knockout pin 149 so as to ascend and descend freely.

An upside die holder 150 is fixed to the lower face of the upside die set plate 144, and an upside guide 151 for guiding the upside die 146 is disposed on the lower face of this upside die holder 150.

On the other hand, an underside die set place 153 is fixed to a bolster plate 188 of the press. An underside cylinder 154 is formed in bolster 152 provided under the bolster plate 188, and an underside piston 155 is inserted into underside cylinder 154. A step portion is formed on underside piston 155, and an auxiliary cylinder 189 is formed between the piston 155 and the bolster 152. A cam mechanism 156 which will be described later is also disposed on underside piston 155.

An underside actuating pin 157 is disposed on the upper face of the underside piston 155, and the upper end of this underside actuating pin 157 abuts against the lower face of an underside die 161 through a pin 187 that slidably penetrates through the underside die set plate 153.

An underside die holder 158 is fixed to the underside die set plate 153 with a bolt 160, and an underside guide 162 for guiding the underside die 161 is disposed on the upper part of die holder 158.

An underside punch 159 is inserted at the central portion of the underside die 161, and a cavity 163 corresponding to the shape of the article 11 to be molded is formed at the upper part of the underside die 161. Penetrating through the central portions of bolster 152 and bolster plate 188, is knockout pin 164 disposed so as to ascend and descend freely.

Further, in this embodiment, a cam mechanism 156 for moving underside piston 155 is disposed on the underside piston 155. This cam mechanism 156 is operated in such a manner that the upper die 146 and the underside die 161 that are maintained with contact are moved toward an underside punch 159 on the fixed side pursuant to the movement of the slide 139 at a speed lower than the moving speed of the slide 139, thereby to have upper and lower punches 147 and 159 rush into upper and lower dies 146 and 161, respectively.

Figure 2:
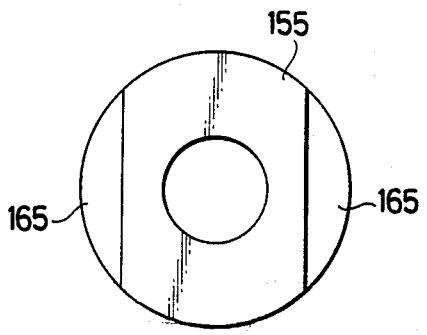
FIG. 2 is a top view of the underside piston shown in FIG. 1.
Figure 3:
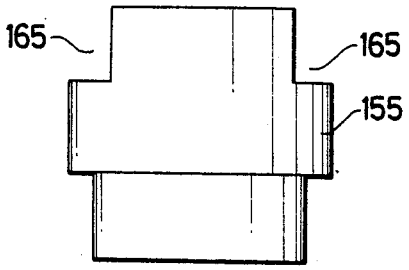
FIG. 3 is a side view showing the underside piston shown in FIG. 2.
Figure 4:
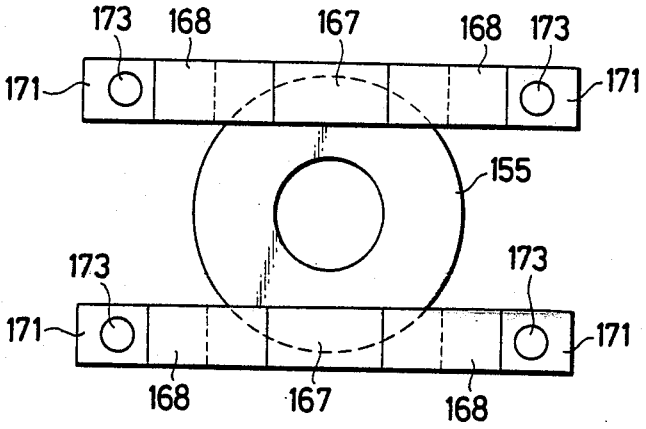
FIG. 4 is a top view showing a state in which a horizontal cam and a vertical cam are disposed on the underside piston.

That is, cutout portions 165 are formed at two locations at angles of 180° on the upper part of the underside piston 155 as shown in FIG. 2 and FIG. 3. Further, both sides of plates 167 have a cam face 166 that is formed and placed at these cutout portions 165 as shown in FIG. 5.

The cam face 169 of the horizontal cam 168 in a plate form abuts against the cam face 166 of this plate 167. Also, cam face 172 of the vertical cam 171 in a plate form abuts against the cam face 170 formed at another end of the horizontal cam 168.

Figure 5:
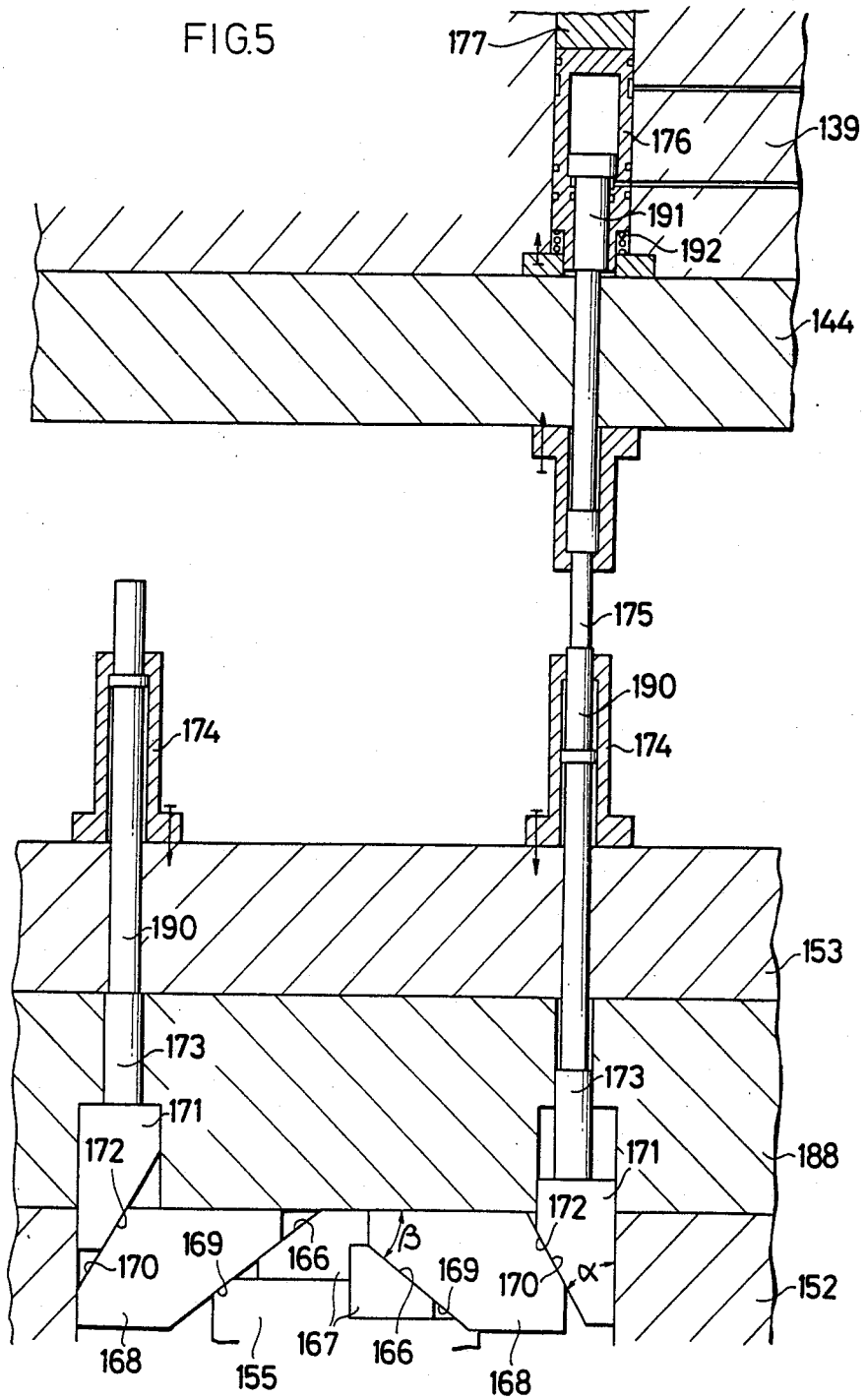
FIG. 5 is an explanatory view for explaining the operation of the cam mechanism shown in FIG. 4.

The lower end of a push pin 173 of the cam mechanism operating portion abuts against the upper face of the vertical cam 171 as shown in FIG. 5. This push pin 173 penetrates through the bolster plate 188, and the upper part thereof abuts against the lower face of a pin 190 which is inserted into a support member 174 fixed to the underside die set plate 153.

A pin 175 abuts against the upper face of pin 190, and the upper part of pin 175 abuts against the lower face of a piston 191 which is inserted into a cylinder 176 disposed in the slide 139.

It is arranged that an oil at a certain pressure is supplied into this cylinder 176 so that the piston 191 may move upward when a great force is applied to the cam mechanism, viz., the pin 175.

Figure 6:
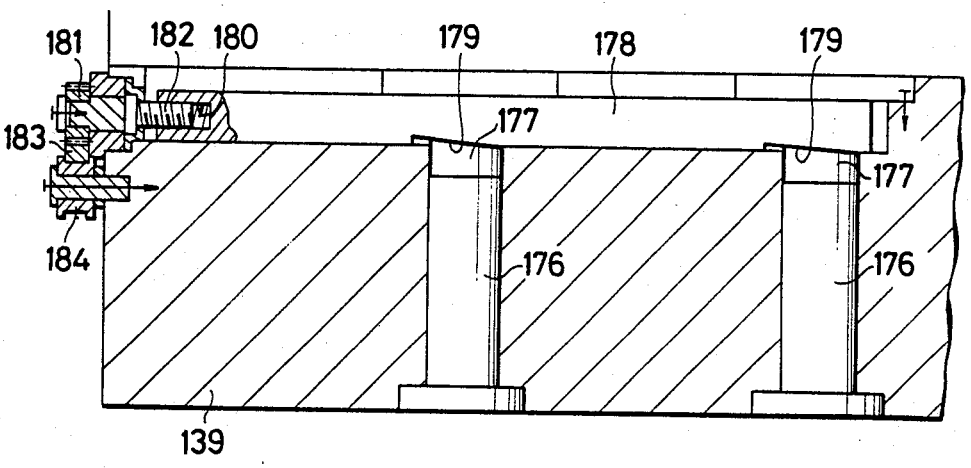
FIG. 6 is a longitudinal cross-sectional view showing a position control mechanism of the cylinder.
Figure 7:
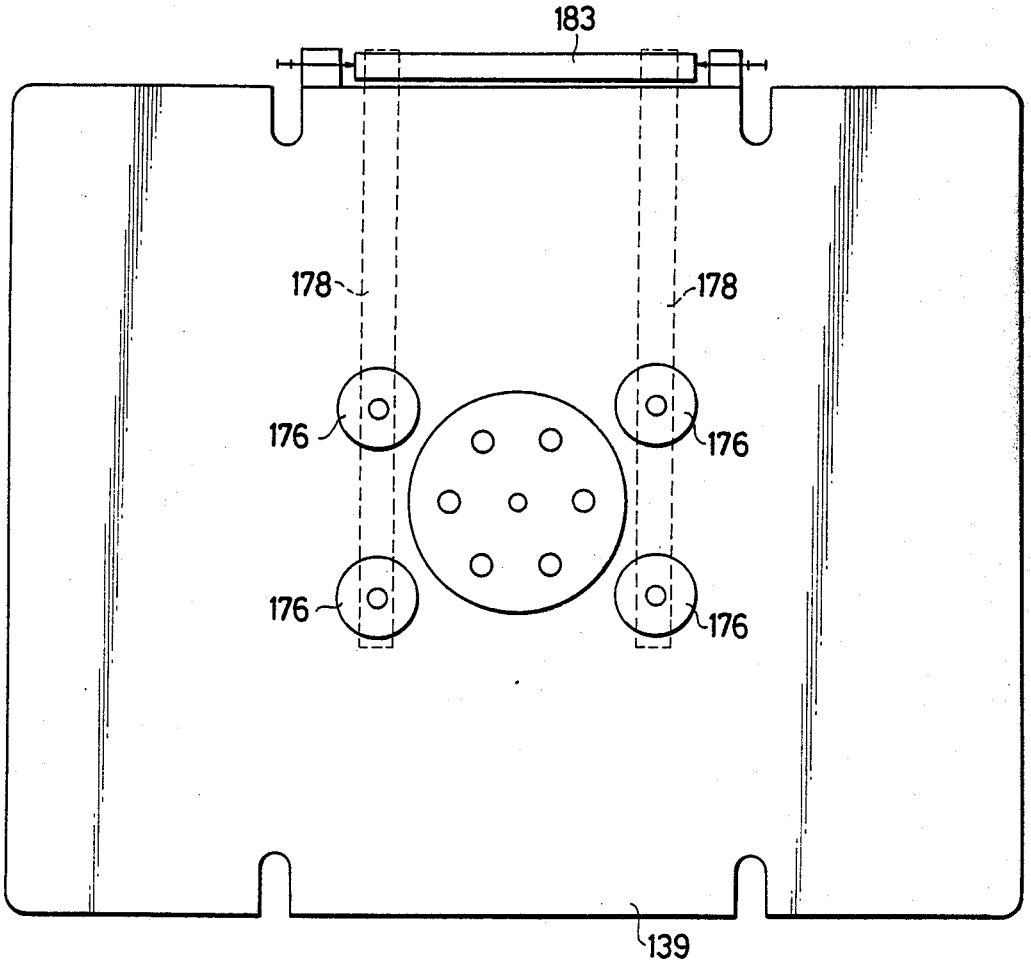
FIG. 7 is an explanatory view showing a position control mechanism of the cylinder.

A cam 177 is disposed on the upper face of the cylinder 176 for controlling the lower face of the piston 191, and a cam face 179 of a cam rod 178 abuts against this cam 177 as shown in FIG. 6 and FIG. 7. The cam 177 is urged upward by means of a spring 192. A female screw portion 180 is formed at an end of cam rod 178, and a male screw portion 182 of a shaft rod fixed with a pinion gear 181 is screw-engaged with this female screw portion 180.

Figure 8:
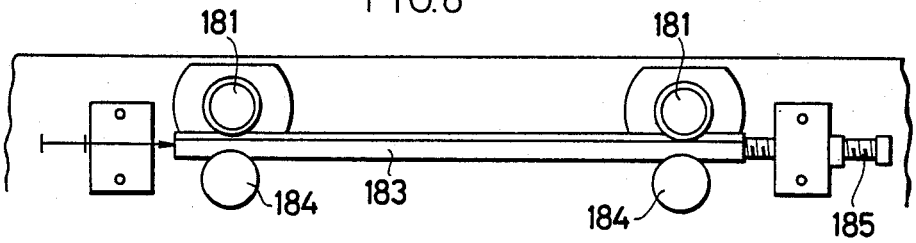
FIG. 8 is a side view showing a position control mechanism.
Figure 9:
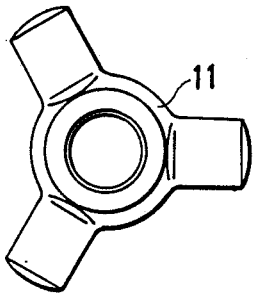
FIG. 9 is a top view showing an example of an article manufactured by a full enclosed die forging.
Figure 10:
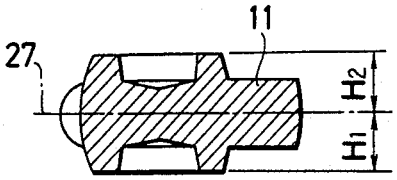
FIG. 10 is a longitudinal cross-sectional view of FIG. 9.
Figure 11:
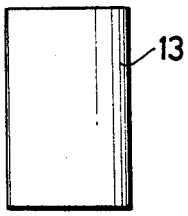
FIG. 11 is a side view showing a slug.
Figure 12:
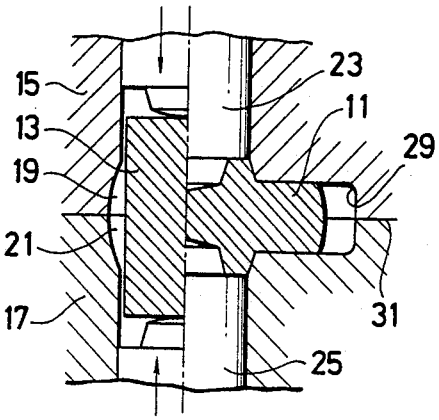
FIG. 12 is a longitudinal cross-sectional view showing a conventional full enclosed die forging method.
Figure 13:
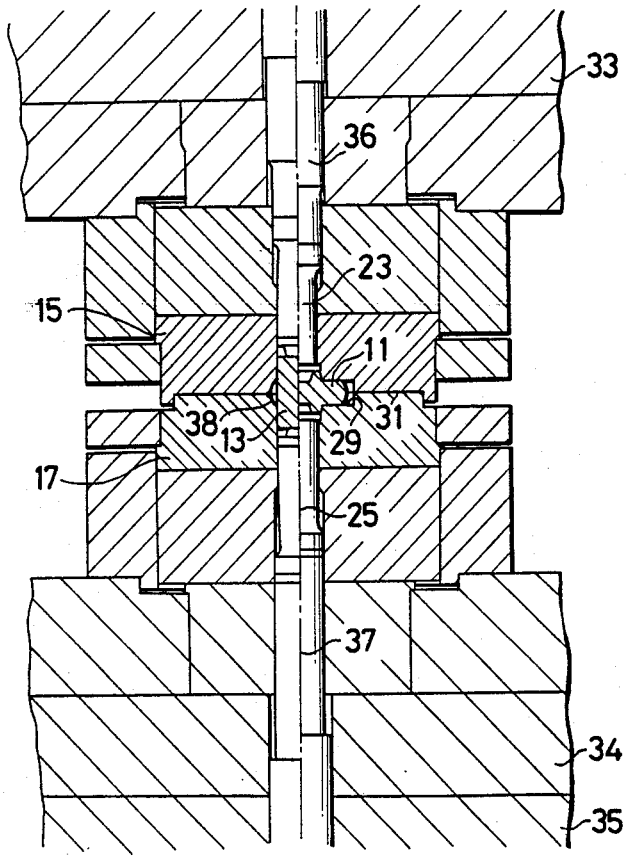
FIG.13 PRIOR ART
FIG. 13 and FIG. 14 are longitudinal cross-sectional views showing conventional full enclosed die forging apparatus.
Figure 14:
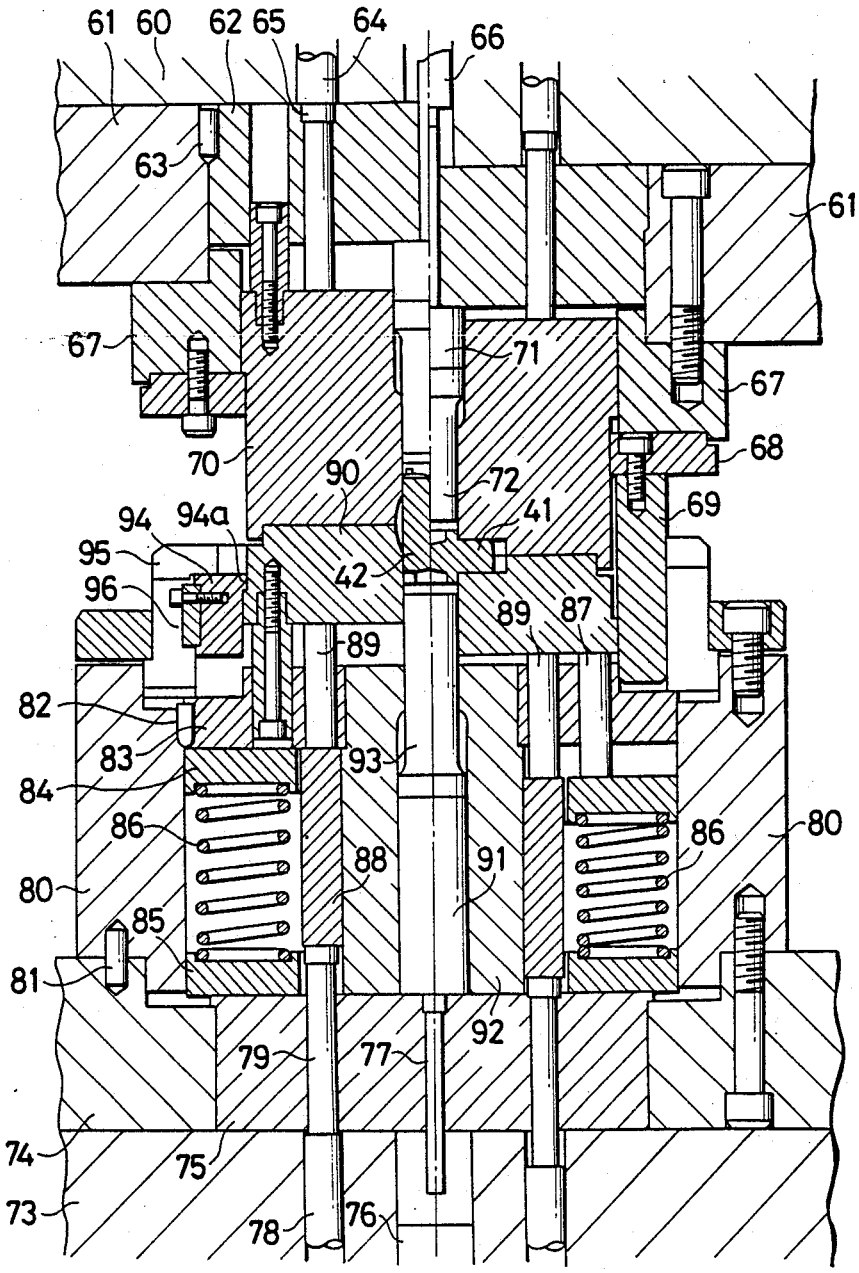
FIG.14 PRIOR ART
Figure 15:
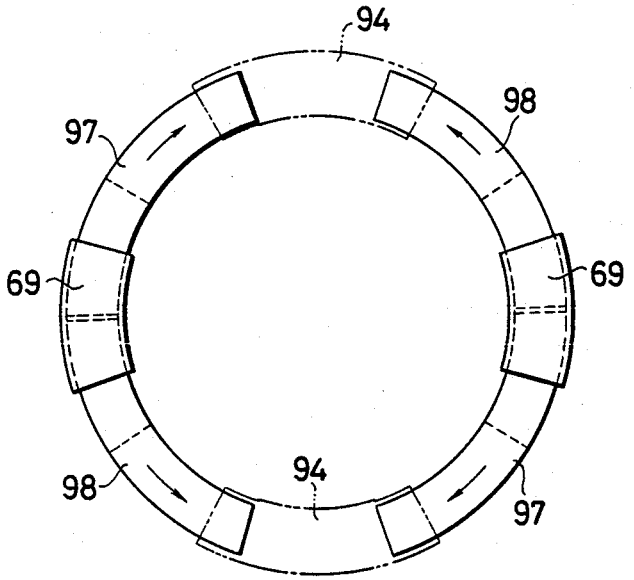
FIG.15 PRIOR ART
FIG. 15 through FIG. 17 are explanatory views showing the cam mechanism of FIG. 14.
Figure 16:
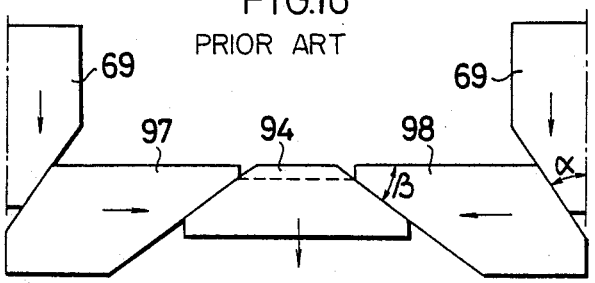
FIG.16 PRIOR ART
Figure 17:
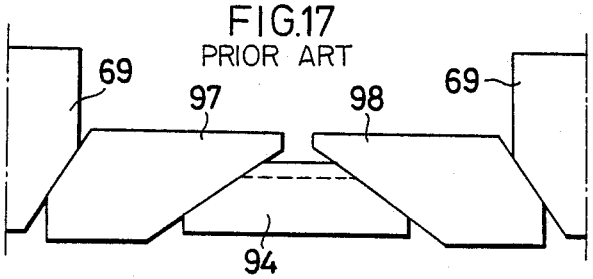
FIG.17 PRIOR ART

As shown in FIG. 8, a rack 183 is screw-engaged with the pinion gear 181, and this rack 183 is supported by rollers 184. By rotating a screw shaft 185 abutting against both ends of the rack 183, it is possible to adjust the lower face position of the piston 191, thereby to adjust dimensions $H_1$ and $H_2$ (FIG. 10) of the forged article 11. This is effectual for correction of dimensional variation of forged articles in mass production and for adjustment when a metal die is newly replaced.

In the full enclosed die forging apparatus thus constructed, the slug inserted into the cavity 163 of the underside die 161 is formed under a fully enclosed state produced by the upside die 146 and the underside die 161 abutting against each other and is taken out by the action of the knockout pin, etc.

And, in the full enclosed die forging apparatus thus constructed, the lower face of the pin 175 and the upper face of the pin 190 abut against each other when the upside die 146 and the underside die 161 come into contact with each other.

Thereafter, when the slide 139 descends further and the push pin 173 also descends, the vertical cam 171 descends as shown in the right side of FIG. 5. With this, the horizontal cam 168 is pressed toward the cam face 166 of the plate 167, the plate 167 moves downward, the underside piston 155 moves downward, and at the same time, the underside die 161 which is urged upward by means of the underside piston 155 also moves downward.

Here, when it is assumed that cam angles of the vertical cam 171 and the horizontal cam 168 are $\alpha$ and $\beta$, respectively, the descending speed ratio of the underside piston 155 to the vertical cam 171 is given as follows:

$$\text{tax}\alpha \times \tan\beta$$

Accordingly, after the vertical cam 171 comes into contact with the horizontal cam 168, the underside die 161 descends at a speed lower than that of the upside punch 147 as the upside punch 147 descends, and the upside punch 147 and the underside punch 159 move relatively to the upside die 146 and the underside die 161.

That is, despite that the upside die 146 and the underside die 161 descend at a speed lower than the descending speed of the upside punch 147, the underside punch 159 does not move. Therefore, when the slide 139 is made to descend, the upside punch 147 and the underside punch 159 rush into the upside die 146 and the underside die 161, respectively, so as to move closely, thereby to perform expected forging.

When, for example, after the upside die 146 and the underside die 161 have contacted with each other, these are made to descend at a half of the descending speed of the slide 139, viz. when a forged article is of face symmetric related to the cross-section of the maximum area, both angles of vertical cam 171 and horizontal cam 168, $\alpha$ and $\beta$, may be selected at 35 degrees 15 minutes 52 seconds theoretically.

Here, when it is assumed that the generating force of the upside cylinder 140 is at $P_U$, the generating force of the underside cylinder 154 is at $P_L$, the generating force of the auxiliary cylinder 189 is at $P_S$, and the force of the plate 167 to push down the cutout portion 165 of the piston 155 is at $P_C$, the force $F_U$ applied to the upside die is:

$$F_U = P_U$$

and the force FL applied to the underside die is:

$$F_L = P_L + P_S - P_C$$

When the forged article has a symmetric form with reference to the cross-section of the maximum area, $F_U = F_L$ is obtained. Namely, $P_C = (P_L - P_U) + P_S$ is obtained.

Here, $P_C > O$ is required in order that respective cam faces are maintained by contact with each other. Such a condition is satisfied by $P_L > P_U$ even if there were no auxiliary cylinder ($P_S = O$). However, for the purpose of stabilizing the cam operation, viz., in order to stabilize the relative speed of the upside punch 147 and the underside punch 159 against the dies during forging and to obtain a forged article of high accuracy, it is desired that the urging force of each cam face, viz., $P_C$ is constant.

However $P_L$ and $P_U$ fluctuate because of viscosity variation of the pressure liquid, mixing of bubbles into the pressure liquid and so forth, thus, $$P_C = P_L - P_U \text{ (when } P_S = O)$$

is hardly constant.

In order to stabilize the urging force of the cam face, it is only required to make the cylinder diameters of the upside cylinder 140 and the underside cylinder 154 equal, and to supply pressure liquid from a common pressure liquid feeding device.

With such arrangement, even if viscosity variation of pressure liquid and mixing of bubbles into pressure liquid are generated, $P_L = P_U$, and in turn $P_C = P_S$, is always obtained.

If a pressure liquid at an atmospheric pressure is supplied to the auxiliary cylinder, $P_S$, viz., $P_C$ becomes constant and the urging force applied to the cam face becomes stabilized, thus a forged article of high accuracy is obtainable.

Here, in the full enclosed die forging apparatus thus constructed, the upside cylinder 140 mechanism is contained in the slide 139 and the underside cylinder 154 mechanism is contained in the bolster 152. Accordingly, the structures of the die set and the metal die may be simplified, replacement and preparation of the metal die are made easier, and further, the clearance between the slide 139 and the bolster 152 may be reduced by a large margin as compared with a conventional case.

Furthermore, in the full enclosed die forging apparatus thus constructed, the underside piston 155 is moved directly by the cam mechanism 156. Therefore, it is possible to reduce the number of parts, and also to surely move the upside die 146 and the underside die 161.

Moreover, in the full enclosed die forging apparatus thus constructed, the upper face of the cylinder 176 is made to abut against the lower face of the cam 177, thereby to determine the vertical position of the cylinder 176. Therefore, by rotating the screw shaft 185 through the rack 183 and the pinion 181 so as to adjust the horizontal position of the cam rod 178, fine adjustment of the lower face positions of four pieces of pistons 191 may be made at the same time, and dimensional adjustment of forged articles also becomes possible.

Also, in the full enclosed die forging apparatus thus constructed, stabilized forged articles of high accuracy are obtainable by adopting an auxiliary cylinder.

Besides, in abovementioned embodiment, it has been described that the cam mechanism 156 is disposed in the bolster 152. However, the present invention is not limited to such an embodiment. It is possible to easily inspect and maintain the cam mechanism 156 by disposing it in the bolster plate 188.

As described above, according to the present invention, the upside cylinder mechanism is contained in the slide, and the underside cylinder mechanism is also contained in the bolster. Accordingly, the die set and the metal die may be structured simply, replacement and preparation become easy, and furthermore, it is possible to reduce the clearance between the slide and the bolster by a large margin as compared with a conventional case.

What is claimed:

1. A fully enclosed die forging apparatus comprising a slide having an upside cylinder mechanism, a bolster having an underside cylinder mechanism, an upside die and an underside die disposed opposedly in a vertical direction between said slide and said bolster, an upside cylinder mechanism contained in said slide which urges said upside die downward, an underside cylinder mechanism contained in said bolster which urges said underside die upward, an upside punch inserted in said upside die that moves synchronously with the movement of said slide, an underside punch inserted in said underside die and supported by said bolster, and a cam mechanism intrinsic to and carried by said underside cylinder mechanism independently from said dies for causing both of said punches to accelerate into said dies by moving said upside die and said underside die downward at a slower speed than the moving speed of said slide.

2. A fully enclosed die forging apparatus as defined in claim 1 wherein said upside cylinder and said underside cylinder have equal diameters, said apparatus comprising an auxiliary cylinder formed between said underside piston and said bolster; said apparatus further comprising a pressure fluid supply device for supplying fluid pressure to said upside cylinder, said underside cylinder and said auxiliary cylinder, whereby pressure fluid entering said equal diameter upside cylinder and underside cylinder causes such force to be presented against said upside cylinder mechanism and said underside cylinder mechanism as to maintain said dies in contact, one with the other, during forging and pressure fluid within said auxiliary cylinder causes additional force to be presented against said underside cylinder mechanism such that said dies are moved toward said underside punch at a speed slower than the moving speed of said slide.

3. A fully enclosed die forging apparatus as defined in claim 1 wherein the cam mechanism is actuated by push pin linkage means interengaging the slide and the cam mechanism.

4. A fully enclosed die forging apparatus as defined in claim 3 wherein the cam mechanism includes a plurality of vertical cams engaging a corresponding plurality of horizontal cams having camming surfaces engaging a piston of said underside cylinder mechanism.

5. A fully enclosed die forging apparatus as defined in claim 4 wherein the push pin linkage means comprises a plurality of push pins each being carried in a respective push pin cylinder carried by the slide.

6. A fully enclosed die forging apparatus as defined in claim 5 wherein the slide carries adjusting means for simultaneously adjusting the relative portion of each push pin cylinder relative to the slide by an equal degree relative to each other for correcting dimensional variations of forged articles.

7. A fully enclosed die forging apparatus as defined in claim 6 wherein the adjusting means comprises a transverse member commonly connecting a plurality of push pin cylinders by cammed surfaces of the transverse member for causing adjusting of the contacted push pin cylinders upon lateral shifting of the transverse member, and means for selectively controlling said lateral shifting.

8. A fully enclosed die forging apparatus as defined in claim 7 wherein there are plural such transverse members, each commonly connecting a plurality of push pin cylinders, said means for selectively controlling said lateral shifting comprising rack-and-pinion means including pinions threadably interengaging each transverse member whereby each transverse member is shiftable at the same time by said rack-and-pinion means.

* * * * *